US007226365B2

(12) United States Patent
Qualizza

(10) Patent No.: US 7,226,365 B2
(45) Date of Patent: Jun. 5, 2007

(54) SHAFT STRUCTURE WITH ADJUSTABLE AND SELF-REGULATED STIFFNESS

(76) Inventor: Gregory Qualizza, 7837 Keystone Rd., Orland Park, IL (US) 60462

( * ) Notice: Subject to any disclaimer, the term of this patent is extended or adjusted under 35 U.S.C. 154(b) by 0 days.

(21) Appl. No.: 11/009,727

(22) Filed: Dec. 10, 2004

(65) Prior Publication Data

US 2005/0261079 A1 Nov. 24, 2005

(51) Int. Cl.

| | |
|---|---|
| ***A63B 53/10*** | (2006.01) |
| ***A63B 53/12*** | (2006.01) |
| ***A01K 87/00*** | (2006.01) |
| ***F17D 1/16*** | (2006.01) |

(52) U.S. Cl. ..... 473/318; 137/14; 43/18.1 R

(58) Field of Classification Search ..... 473/318, 473/316; 280/819; 43/18.1 R, 18.5; 137/14, 137/804

See application file for complete search history.

(56) References Cited

U.S. PATENT DOCUMENTS

| | | | | |
|---|---|---|---|---|
| 1,831,255 | A | | 11/1931 | Menzies |
| 4,800,668 | A | * | 1/1989 | Burrough ..... 43/18.1 R |
| 5,082,279 | A | | 1/1992 | Hull et al. |
| 5,316,300 | A | | 5/1994 | Simmons |
| 5,540,625 | A | | 7/1996 | Koch et al. |
| 5,632,693 | A | | 5/1997 | Painter |
| 5,904,628 | A | | 5/1999 | MacKay, Jr. et al. |
| 6,361,451 | B1 | | 3/2002 | Masters et al. |

* cited by examiner

*Primary Examiner*—Stephen Blau
(74) *Attorney, Agent, or Firm*—Olson & Hierl, Ltd

(57) ABSTRACT

A shaft structure with adjustable and self-regulating stiffness is provided for golf clubs, fishing rods, and the like. The shaft structure employs in a presently preferred form a hollow tube in which a piston and a longitudinally spaced platen, each longitudinally slidable, are incorporated. The piston and platen are separated from one another by a spring biasing member. The platen is position controlled longitudinally by a longitudinally extending jackscrew that is rotatable and threadably associated with that platen, but that is longitudinally fixed relative to the tube. The chamber defined on one side of the piston contains a fluid which can be a gas or a liquid, and the platen assumes a position along the shaft which to corresponds to a location where forces on each side of the piston are equalized. Rotating the jack screw causes the platen to move longitudinally, the direction depending upon the direction of jackscrew rotation. This movement causes the piston to relocate to a position where the respective pressures on each side thereof remain equalized.

12 Claims, 7 Drawing Sheets

SHAFT STRUCTURE WITH ADJUSTABLE AND SELF-REGULATED STIFFNESS

FIELD OF THE INVENTION

This invention relates to shafts for golf clubs, fishing rods and the like wherein shaft stiffness is adjustable and automatically regulated by controlling internal fluid pressures within hollow portions of the shaft.

BACKGROUND OF THE INVENTION

Golf shafts are typically manufactured with a predetermined stiffness or flex. The term "stiffness" refers to a shaft's flex characteristics. A golfer can choose among golf shafts of different stiffnesses produced by various manufacturers. However, one manufacturer's "regular" flex could be another manufacturer's "stiff" flex, and vice versa.

It is well known that the stiffness or flex of a golf shaft plays a fundamental role in the behavioral characteristics of a golf club. The stiffness of a golf club shaft and the so-called kick point affect, for example, the launch angle or trajectory of the ball and the distance of ball travel. A shaft can have a high kick point (maximum bend closer to the grip), or a low kick point (maximum bend closer to the club head) or a kick point at a location there between Prevailing weather conditions can also affect the optimum stiffness for a club shaft. For example, on a windy day, a golfer might choose to use a club head associated with a shaft that has a low or a high stiffness in order to better control the trajectory of the ball. Or an older golfer may desire to use a golf club with a more flexible shaft than a stiff shaft with the goal of having the ball travel farther.

Various proposals to provide a variable stiffness for a golf club shaft (or even a fishing pole) have previously been made that involve using a hollow shaft charged with a gas or liquid fluid that can be pressurized. Increasing the fluid pressure in the shaft increases the shaft stiffness. Such pressurizable shafts are illustrated, for example, by Menzies U.S. Pat. No. 1,831,255, Sears U.S. Pat. No. 2,432,450, Busch U.S. Pat. No. 3,037,775, Burrough U.S. Pat. No. 4,800,668 (a fishing rod), Simmons U.S. Pat. No. 5,316,300, Koch et al. U.S. Pat. No. 5,540,625, and Painter U.S. Pat. No. 5,632,693.

So far as is known, these fluid charged, variable stiffness, hollow shaft structures of the prior art suffer from the problem that a change in the external environmental temperature inherently causes a significant change in the internal shaft pressure and thus in the shaft stiffness. The change in shaft thickness occurs because temperature changes cause pressure changes in the shaft fluid. Changes in shaft stiffness can dramatically affect the performance characteristics of a golf club. In view of a shaft stiffness change caused by an external temperature change, the performance characteristics of the shaft will change. Outside environmental temperature changes can occur relatively rapidly not only from day to day, but even during a single round of golf. A golfer's expectation that the fluid charged shaft of one of his golf clubs maintains a constant flex characteristic is no longer true after a change in the temperature.

In order for a golf club whose stiffness is regulated by a fluid in its hollow shaft to be practical, the shaft needs to have a stiffness that not only is adjustable but also is able to maintain a chosen stiffness automatically in response to changes in exterior environmental temperature. The present invention overcomes the inability of prior art fluid-filled shafts to maintain a chosen stiffness environmental temperature changes. A shaft is provided which is stiffness adjustable and automatically maintains a selected stiffness regardless of exterior temperature changes.

SUMMARY OF THE INVENTION

More particularly, this invention relates to a shaft structure for golf clubs, fishing poles and like apparatus incorporating an inventive flexible shaft structure. The shaft structure is hollow, has an adjustable and selectable stiffness, and automatically regulates the club stiffness when the exterior environmental temperature changes.

The hollow shaft has proximal and distal opposite end regions and contains a longitudinally slidable piston and a movable platen that are in longitudinally spaced relationship relative to each other. A chamber is defined in the shaft between the piston and the distal end. The movable platen includes guidance means for preventing rotational movement thereof relative to the shaft. Spring biasing means extends in the shaft between the piston and movable platen.

A jackscrew extends longitudinally and preferably axially in the shaft between the proximal end region and the movable platen. The jackscrew has a forward portion that threadably extends through the movable platen and has a rearward portion that extends through the proximal end region so that the jackscrew is rotatable relative thereto, but is not longitudinally translatable relative thereto. In the shaft, a first chamber is defined between the piston and the distal end region and another chamber is defined between the piston and the movable platen. When rotational force is applied to the jackscrew rearward portion, the jackscrew remains longitudinally stationary but rotates and causes the movable platen to move longitudinally and slidably in the shaft, the direction of longitudinal movement of the movable platen being dependent upon the direction of rotation imparted by the applied rotational force.

In the assembled shaft structure, the interrelationship between the hollow shaft, the spring biasing means, the movable platen, and the piston is such that two results are achieved:

- The piston assumes a longitudinal location in the shaft where the pressure of fluid (preferably a gas, though a liquid may be employed, if desired) in the first chamber and hence the force imposed upon the piston is approximately equal to force imposed upon the piston by the spring. When external environmental temperature changes cause fluid pressure in the first chamber to change, the piston slidably moves in the shaft until the respective force in the first chamber are equalized by the force created by the spring biasing means, thereby to maintain a selected shaft stiffness.
- The force exerted upon the piston by the spring biasing force is changed when the jackscrew is rotated and the movable platen is moved longitudinally in the shaft. This change causes the piston to move longitudinally to a location in the shaft where the force in the first chamber is again approximately equal to the force created by the spring biasing means. Thus, the stiffness of the shaft is selectable.

The piston characteristically is preferably in a gas-tight relationship with the respective adjacent portions of the shaft interior walls.

The invention is adapted for use in a variety of different embodiments using a number of various components, as those skilled in the art will readily appreciate.

In one presently preferred type of embodiment, the shaft proximal end region is provided with modifications that enable better control of the jackscrew or that enable convenient regulation of fluid content and pressures in the shaft chambers using exterior fluid sources. For example, the proximal end region may include an inwardly spaced stationary bulkhead member, and may be provided with means for controllably introducing a fluid into, or withdrawing a fluid from, a predetermined portion of the shaft structure.

One object of the present invention is to provide a shaft structure which both has a selectable or adjustable stiffness and also has a shaft stiffness that is automatically self-adjusted to maintain the selected stiffness even though the environmental exterior temperature changes. Such an environmental temperature change inherently causes the shaft internal pressure to change which in turn causes a change in shaft stiffness. With the present invention, a selected shaft stiffness is maintained regardless of external environmental temperature. Thus, the present invention overcomes the above-noted disadvantage of the prior art fluid-filled shaft structures which have no means for maintaining selected shaft stiffness when the exterior environmental temperature changes.

Another object of the present invention is to provide a shaft structure which has an adjustable and selectable shaft stiffness.

Another object of the present invention is to provide a shaft structure which has both a selectable or adjustable shaft stiffness and also a shaft stiffness that is automatically self-adjusted. Thus, after adjustment to a desired stiffness, the shaft structure automatically self-adjusts so that the desired stiffness is maintained regardless of environmental temperature changes. Hence, single such shaft structure can replace many different combinations and permutations of golf shafts, golf clubs, and manufacturing procedures, and can avoid the need for large inventories of golf clubs with golf club shafts pre-set to different stiffness values, thereby effecting a saving of what would otherwise be an expenditure of substantial amounts of money.

Another object of the present invention is to provide a shaft structure that, after adjustment to a desired thickness, automatically self adjusts so that a desired stiffness is maintained regardless of environmental temperature changes. Thus, for example, a golfer can control the shaft stiffness characteristics of a golf club subset, or even all the golf clubs of his entire club set, so that all selected clubs have the same stiffness.

Another object of the present invention is to provide a golf club shaft structure which allows a golfer to customize the stiffness of each member of a set of clubs, or of a fishing pole, according to his ability or wishes without being dependent upon the shaft stiffness that happens to result from shaft manufacturing procedures as in the prior art.

Another object of the present invention is to provide a fishing rod structure which allows a fisherman to select the stiffness desired for his fishing rod and where once selected the rod will self-maintain the selected thickness regardless of environmental temperature changes.

Other and further objects, aims, features, advantages, applications, embodiments and the like regarding the present invention will be apparent to those skilled in the art from the present specification, attached drawings, and appended claims.

DETAILED DESCRIPTION

Figure 2A:
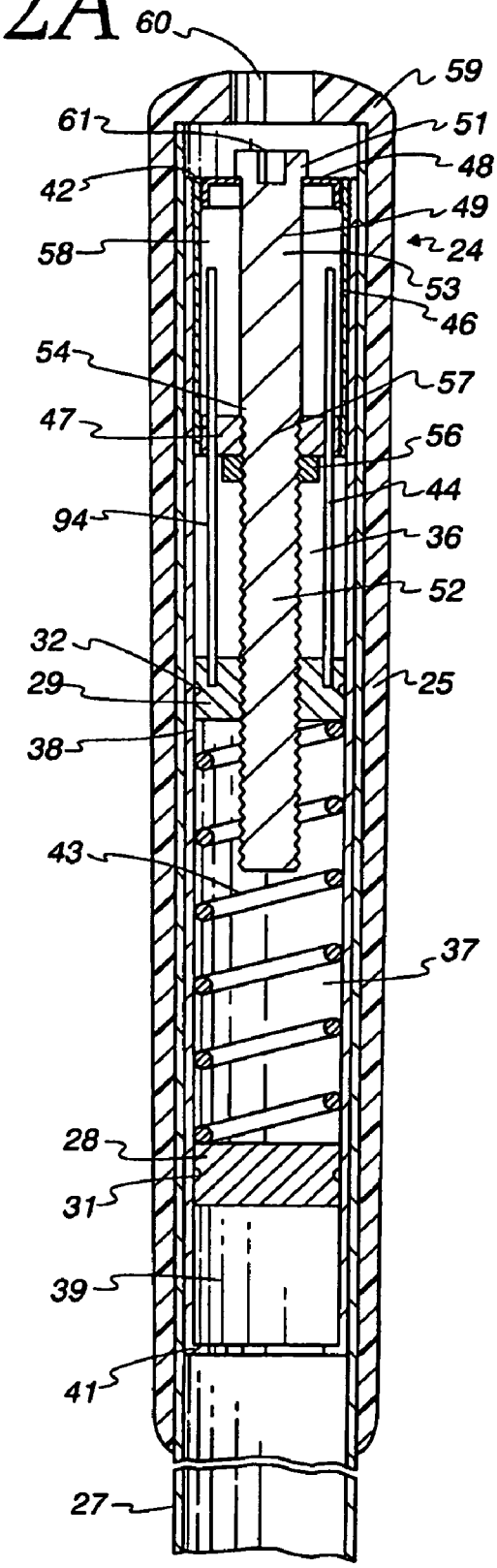
FIGS. 2A and 2B provide an enlarged, detailed view in vertical axial section of the shaft structure of FIG. 1 with the club head removed.
Figure 1:
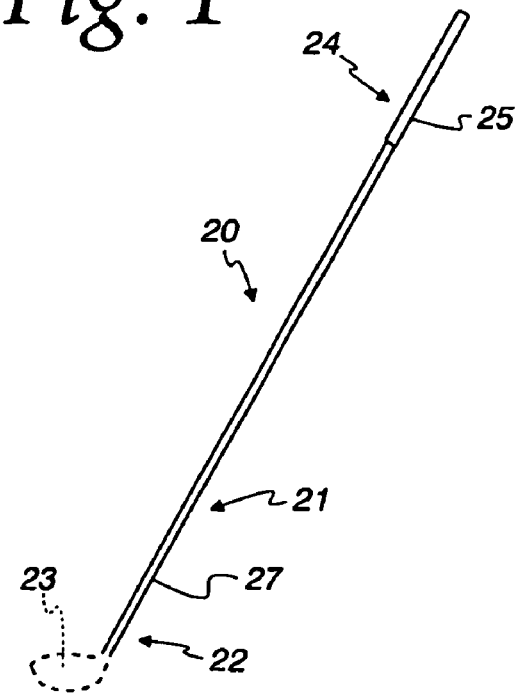
FIG. 1 is an environmental, perspective view of one embodiment of a golf club which incorporates a shaft structure of the present invention.
Figure 2B:
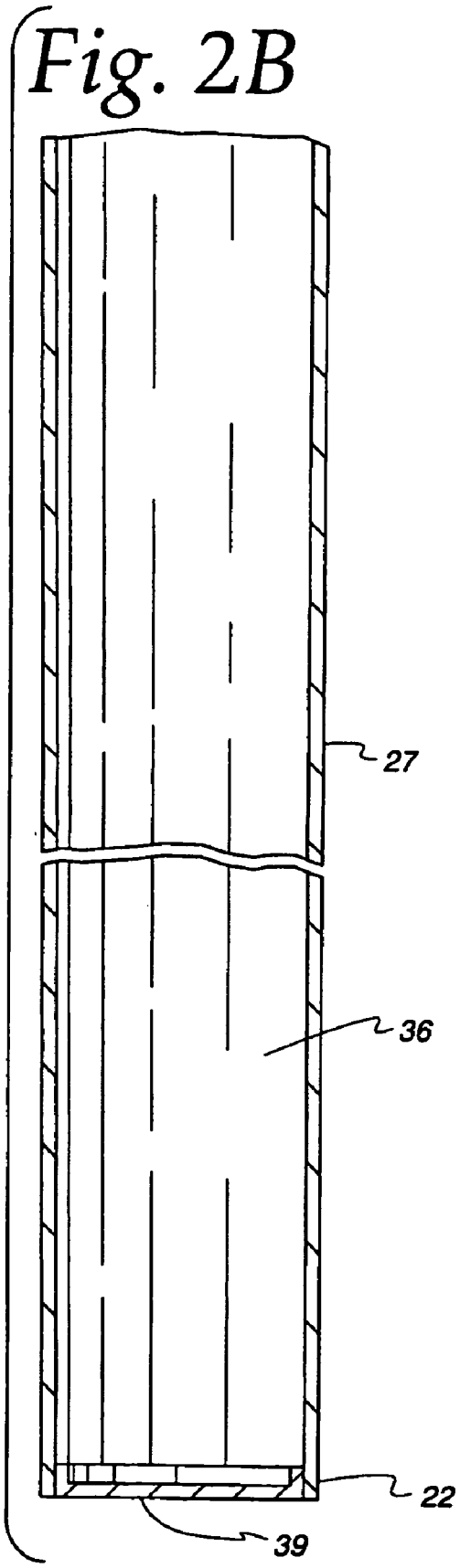
Figure 3:
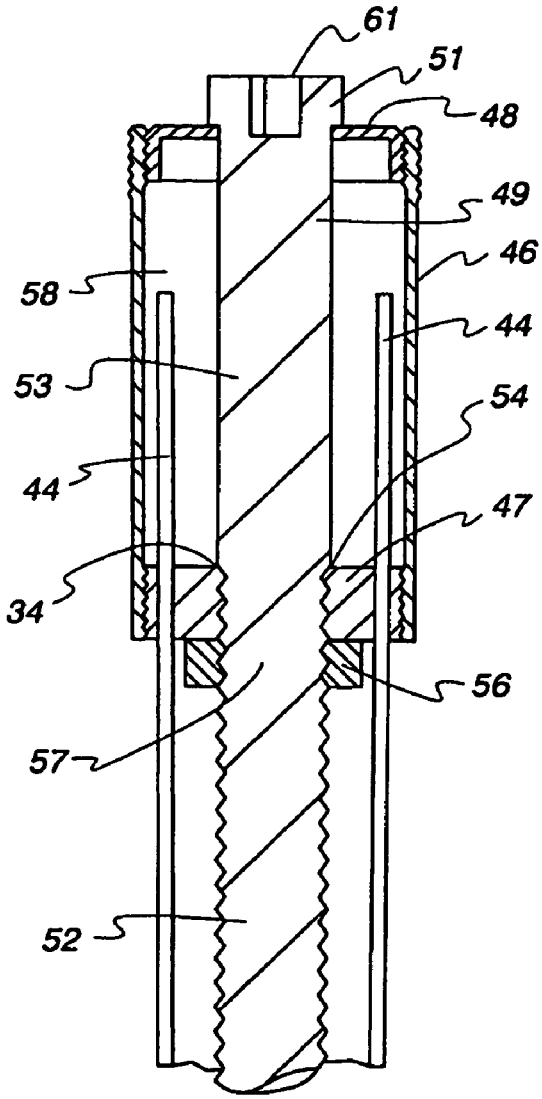
FIG. 3 is a detailed view of the subassembly employed in the upper end portion of the shaft structure shown in FIG. 2A.

FIGS. 1, 2A, 2B and 3 show an illustrative golf club 20 that incorporates an embodiment 21 of a shaft structure of the present invention. Shaft structure 21 is associated at its lower or distal end region 22 with a conventional club head 23 (not detailed structurally) and at its upper or proximal end region 24 with an illustrative, circumferentially extending, conventional handle 25 (not detailed structurally). Various club heads and golf club handles can be associated with the shaft structure 21. As shown, for example, in FIGS. 2A and 2B, the shaft structure 21 utilizes an elongated, fluid impermeable, hollow, cross-sectionally circular, fluid-holding, elongated tubular shaft 27.

In embodiment 20, the upper portion of the shaft 27 preferably is provided with a tubular sleeve 38 comprised of metal or the like that is telescopically received therein and that has outside side wall portions that are preferably bonded by a conventional adhesive (not detailed) to adjacent inside wall portions of the shaft 21. The sleeve 38 acts as a reinforcement for the shaft 27 and may be considered to be part of the shaft 27.

In embodiment 20, a spacing and positioning sleeve 46 is provided that is slidably and nestably engageable within the upper end portions 42 of sleeve 38. The upper outer edge adjacent region of sleeve 46 is threaded internally and externally. The external threads are adapted for engagement with adjacent interior threads defined upon the upper end portion 42 of sleeve 38. The longitudinally lower interior edge adjacent region of sleeve 38 is threaded and adapted for threaded engagement with the peripheral outer cylindrical edge of a bulkhead 47. When the sleeve 46 is telescopically engaged within the sleeve 38, sleeve 46 is threadably engaged with the sleeve 38, and the bulkhead 47 as threadably engaged with the lower end of the sleeve 46 is so is in a longitudinally fixed location that extends transversely across the sleeve 46, the sleeve 38 and the shaft 27, as desired.

A piston 28 and a movable platen 29 are located in the sleeve 38 and thus in the shaft 27. The piston 28 and movable platen 29 are normally in longitudinally spaced relationship relative to each other. Piston 28 and movable platen 29 are each independently longitudinally slidable within the sleeve 38. Piston 28 is in gas tight relationship relative to adjacent interior wall portions of the sleeve 38. To assure such a gas tight relationship, piston 28 is preferably provided with a small, circumferentially extending groove 31 that is defined medially in its outer cylindrical peripheral surface, and a preferably sealing ring gasket, not shown, is located in groove 31. If desired, optimally, platen 29 can be correspondingly provided with a groove 32 and provided with a sealing ring gasket (not shown).

A first chamber 36 is defined between the bulkhead 47 and the movable platen 29. A second chamber 37 is defined between piston 28 and movable platen 29. A third chamber 39 is defined between the piston 28 and the normally closed lower end region 22 of shaft 27 which end region 22 is illustratively provided with a generally transversely extending terminal closing sealing plate 39 that is provided with peripheral edge portions that are adjacent to the shaft 27 and that are conveniently bonded thereto by a conventional adhesive (not detailed) in the assembled golf club 20.

Lower edge portions 41 of the sleeve 38 are preferably in-turned and the upper end portions 42 of the sleeve 38 are longitudinally inset from the upper end of the shaft 27. The lower edge portions 41 act as a stop that limits downward longitudinal travel of the piston 28. Between the piston 28 and movable platen 29 a coiled compression spring 43 of steel or the like is preferably located. The spring 43 normally and preferably exerts a force that tends to move piston 28 and movable platen 29 apart.

As those skilled in the art will readily appreciate, various alternative arrangements involving the hollow shaft 27, piston 28 and movable platen 29 and the spring 43 can be employed, if desired. For example, for reasons of shaft structure 21 strength, the lower end region 22 of shaft 27 may be solid. The shaft 27, the sleeves 38 and 46 and piston 28 and movable platen 29 can each be fabricated of various conventional materials including steel and steel alloys, aluminum and aluminum alloys, titanium and titanium alloys, plastics, fiberglass filled resins including polyesters, fibrous carbon and graphite filled resins including epoxy matrices, polyacrylonitrile and pitch, carbon fiber and other composites, and the like, as those skilled in the art will readily appreciate. For example, if desired, the shaft 27 may be exteriorly tapered and progressively narrowed in cross-sectional diameter proceeding from the upper end region 24 to the lower end region 22 (an illustrative exteriorly tapered embodiment of shaft 27 is not being shown for reasons of simplicity), but it is preferred that the internal diameter of the shaft 27 be uniform and constant over the longitudinal distance of the shaft 27 within which the piston 28 and movable platen 29 are to be slidably movable longitudinally within the shaft 27.

A cap 48 is provided having an in-turned, externally threaded, peripheral lip portion that is adapted to threadably engage interior threads defined at the upper end of the sleeve 46. A center bore is defined through each of the cap 48 and the bulkhead 47. A jackscrew 49 is slidably extended through the center bore in the cap 48 until the head 51 of the jackscrew 49 is adjacent the cap 48. The jackscrew 49 has a threaded forward end region 52 that is threadably engaged with, and extends through, a center bore defined in the movable platen 29. The body of the jackscrew 49 is here configured so that the threaded forward region 52 has a smaller diameter than the unthreaded rearward region 53 thereof. A shoulder 54 that is defined in the jackscrew 49 between the rearward region 53 and the forward region 52 is adapted to be positioned against the upper side of the bulkhead 47 when the head 51 is adjacent the cap 48. In the region 52, a longitudinally short region 57 is provided that is located along and around the jackscrew 49, that extends above the upper end of the threaded rearward region 53, and that extends below the bulkhead 47 in the assembled shaft assembly 21. To retain the jackscrew 49 in association with the cap 48 and with the bulkhead 47, and with the jackscrew 49 being rotatable relative thereto, a conventional clamp ring 56 is provided. The clamp ring 56 is mounted around and over the region 57 of the jackscrew 49 adjacent to the bulkhead 47, but permits the jackscrew 49 to be rotated by turning its head 51.

To prevent rotational movement of the movable platen 29, and to guide longitudinal movement of the movable platen 29 relative to the interior of the sleeve 38 and the shaft 27, the movable platen 29 is associated with at least one longitudinally extending keyway means. In embodiment 20, the keyway means is provided by a plurality of circumferentially spaced guide pins 44. Preferably, two guide pins 44 are utilized that are diametrically opposed to each other relative to the shaft 27 and the movable platen 29. The pins 44 extend longitudinally from terminal embedment in the movable platen 29 towards the proximal end region 24 and pass slidably through aligned holes in the bulkhead 47. Preferably, the individual pins 44 have similar lengths, and the length of the pins 44 is such that, in the assembled golf club 20, when the movable platen 29 has been longitudinally moved along the threads in the threaded forward region 52 of the (revolvably moved) jackscrew 49, and the movable platen 29 is locatable at a desired position in sleeve 38, and the pins 44 are still slidably engaged with the bulkhead 47. Yet, when the movable platen 29 has been longitudinally moved along these threads in region 52 in the opposite direction, the movable platen 29 is locatable adjacent to the region 57. The pins 44 are fully accommodated in the head chamber 58 that is defined in the sleeve 46 between the cap 48 and the bulkhead 47. During initial assembly of the club 20, it is convenient and preferred for piston 28 to be positioned in a forward end region of the sleeve 38 and for the movable platen 29 to be located in sleeve 38 so as to be approximately in a medial position along the threads in region 52 of jackscrew 49. Various alternative keyway means, component assemblies and assembly techniques can be employed, as those skilled in the art will readily appreciate.

In assembly of club 20, the piston 28 and the movable platen 29 can be preliminarily positioned in the sleeve 38 that has been telescopically associated with the shaft 27. Conveniently, the sleeve 46 is preliminarily assembled with the bulkhead 47, the cap 48, the jackscrew 49, the movable platen 29 and the pins 44. Then the resulting subassembly of these components is then associated with the sleeve 38 through its upper end portion 42. In this manner of assembly, piston 28 is preliminarily positioned in the sleeve 38, and the movable platen 29 is preliminarily threadably associated with the jackscrew 49 and associated with the sleeve 38. The resulting assembly has the component interrelationship shown, for example, in FIG. 2A. The handle 25 can then be mounted over and about the proximal end region 24 of the shaft 21. Preferably an access hole 60 is provided in the upper end 59 of the handle 25. On the assembled club 20, through hole 60 the polygonally (preferably hexagonally)-sided projecting head of a conventional wrench (not shown) can be extended and matingly received and engaged with a mating polygonally (preferably hexagonally)-sided pocket recess 61 defined in the upper central end of the head 51. Thereby, the jackscrew 49 can be turned (rotated) to adjust the longitudinal position of the movable platen 29 in the assembled golf club 20.

As the golf club 20 is assembled in an atmospheric environment, inherently, contain a gaseous fluid (i.e., air). Examples of suitable inert, colorless gases include helium, argon, carbon dioxide, nitrogen, air or the like.

Instead of a gas, the fluid in chamber 36 can be a selected liquid, such as an inert liquid that has a boiling point which is above ambient temperatures and pressures, for example, a boiling point preferably above about 150 degrees C. Although higher and lower boiling point fluids can be used if desired. A selected liquid can be easily introduced into chamber 36 during assembly of a golf club 20, as those skilled in the art will readily appreciate. Illustrative suitable inert, stable, non-aqueous liquids include glycols, petroleum hydrocarbon liquids such as oils, synthetic silicone liquids, and the like.

If desired, a fluid in a golf club 20 can comprise a mixture of gas and liquid, such as, for example, a stabilized emulsion where, for example, nitrogen or other inert gas comprises the discontinuous phase and a silicone oil or other inert liquid comprises the continuous phase. Such a mixed fluid can be chosen, if desired, so as to have a pressure-responsive compressibility characteristic that is intermediate between the corresponding compressibility characteristics for a gas and for a liquid, as those skilled in the art will appreciate.

For reasons of providing the relatively largest practical capacity for incremental or infinitely variable adjustment capacity for shaft stiffness in a shaft structure of the invention, it is presently preferred to employ a fluid in a shaft assembly 27 which is a gas. However, the weight of a golf club can be adjusted by regulating the density of the particular fluid employed in charging chambers defined in golf shafts. For example, to increase golf shaft weight, instead of a gas such as nitrogen or air that is charged to a shaft chamber, one can employ, for instance, an organic liquid, or a synthetic silicone oil, such as one that has a heavy metal chemically incorporated thereinto.

Adjustment of pressure in chamber 37 is carried out by adjusting the longitudinal position of the movable platen 29 in the sleeve 38. A change in then longitudinal position of the movable platen 29 is produced by turning the jackscrew 49, as above described. Changing the longitudinal position of the movable platen 29 changes the force upon movable platen 29 by virtue of spring 43. Initially, before a pressure change in chamber 37 is initiated, the pressure in each of second chamber 37 and third chamber 39 is approximately equal since the piston 28 slidably moves in sleeve 38 to a position where the pressures upon opposing faces of the piston 28 are approximately equal. Changing that pressure changes the pressure applied against one face of piston 28. When the pressure in the third chamber 39 is approximately constant during changes in the pressure of the second chamber 37, and the pressure in the second chamber 37 is changed (by turning the jackscrew 49), the piston 28 is caused to move to a new position where the pressure on each opposed face of the piston 28 is again equalized. The fluid pressure in the chamber 37 is adjusted by means of the position of the movable platen 29 and hence the position of the piston 28 is adjusted. It is preferred for the volume or longitudinal length of the chamber 37, which is in effect defined by the pressure produced by the spring pressure therein, to be smaller, preferably much smaller, than the volume or longitudinal length of the chamber 39, which is in effect defined by the pressure of fluid in chamber 39. Adjusting the position of the piston 28 in the sleeve 38 thus regulates the pressure in third chamber 39 and consequently the stiffness of the shaft 27.

The longitudinal force of the pressure exerted by the spring 43 can be considered to be proportional to the pressure associated with the fluid in chamber 37. The spring 43 force exerted on piston 28 can be selected so as to be equal to or substantially greater than that exerted by the fluid in chamber 36 on piston 28.

The amount of spring force utilized in chamber 37 can be variously selected. For example, the spring force can be selected so as to determine a desired longitudinal length for the chamber 37 relative to the longitudinal length of the chamber 36. In the shaft structure 21, piston 28 assumes a longitudinal position in the shaft 27 where the pressure of the fluid in the first chamber 39 is approximately equal to the pressure of the spring force in the second chamber 37. Pressure changes in shaft structure 21 are produced by changes in environmental temperature. With the movable platen 29 at a selected location, when, for example, the external environmental temperature changes in the vicinity of a golf club 20, the temperature of the shaft structure 21 changes, and the pressure of the fluid in the third chamber 39 inherently changes. Responsive to such a pressure change in the chamber 39, piston 28 moves longitudinally in the shaft 27 until the force provided by the pressure in chamber 39 is equal to the force supplied by the spring 43. Under the changed conditions, one may desire to move the movable platen 29 longitudinally from one position to another in the sleeve 38 by means of rotation of the jackscrew 49, thereby to achieve a different stiffness for the shaft structure 21. Such a movement of movable platen 29 causes the pressure exerted on the piston 28 to change. The result is that the piston 28 moves slidably to a position where the force on each side of the piston 28 is again effectively equalized.

Embodiments where external pressure sources are employed to regulate pressure in the chambers of a shaft structure of the invention are illustrated below.

Figure 4:
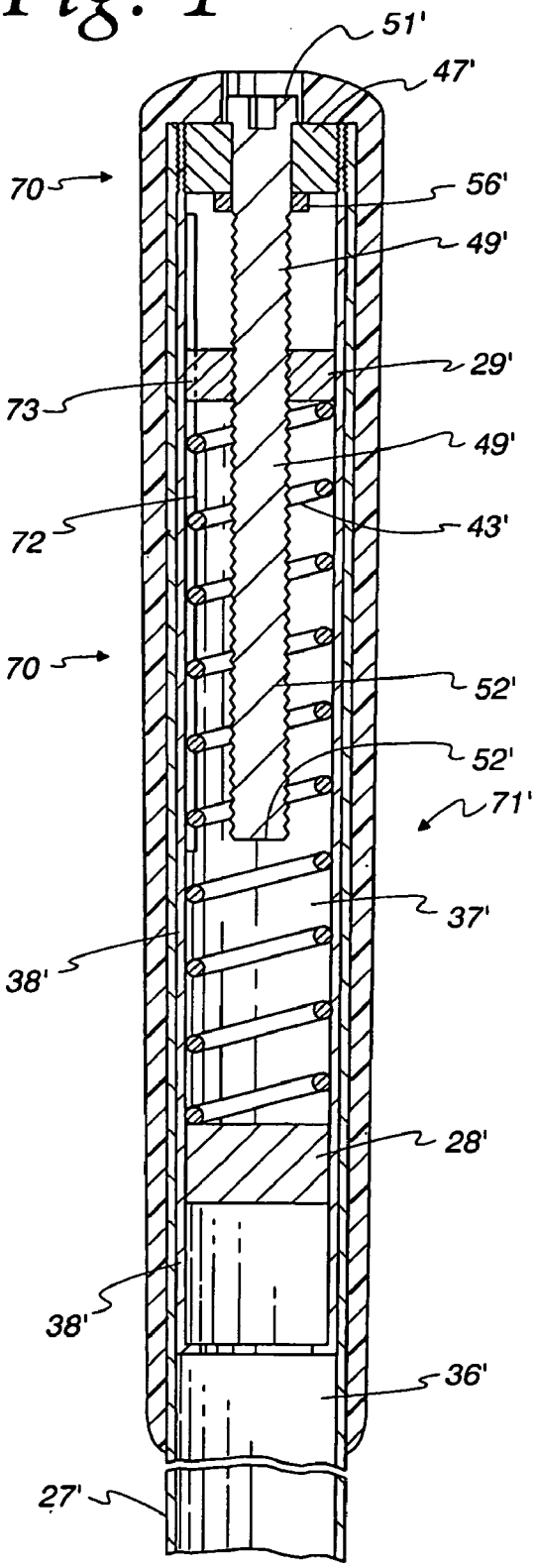
FIG. 4 is a view similar to FIG. 2A, but showing fragmentarily an alternative embodiment of the inventive shaft structure.

A different golf club embodiment 70 that employs a shaft structure 71 of the present invention is seen fragmentarily in FIG. 4. Components of club 70 and shaft structure 71 that are similar to corresponding components in club 20 and shaft structure 21 are similarly numbered but with the addition of prime marks thereto for convenient identification purposes. As in club 20, in club 70, the shaft 27' is associated with a sleeve 38'. The jackscrew 49' is rotatable and is longitudinally and axially extended through a bulkhead 47' that is here located adjacent to the proximal end of shaft 27'. The forward end region 52' of the jackscrew 49' is threadably and axially (relative to shaft 27') extended through the center region of movable platen 29'. The jackscrew 49' head 51 is adjacent one face of the bulkhead 47' and a clamp ring 56' is positioned adjacent the opposing face of the bulkhead 47', thereby to retain the jackscrew 49' in a longitudinally fixed but rotatable position. The bulkhead 47' is circumferentially threaded and is threadably engaged with mating threads defined on the inner upper edge region of the sleeve 38' while the outer upper edge of the sleeve 38' is threadably engaged with adjacent portions of the shaft 27' so the position of the bulkhead 47' is fixed in the shaft structure 21'.

In embodiment 70, the keyway means is provided by a longitudinally extending key ridge 72 that is mounted to and extends longitudinally along an inside surface of the sleeve 38'. The movable platen 29' is provided with a longitudinally extending, circumferentially edge located groove 73 which is adapted to engage matingly and slidably move over the ridge 72, thereby guiding the movable platen 29' longitudinally and preventing rotation thereof. A spring 43 is positioned between the movable platen 29' and the piston 28' in the sleeve 38'.

Figure 5:
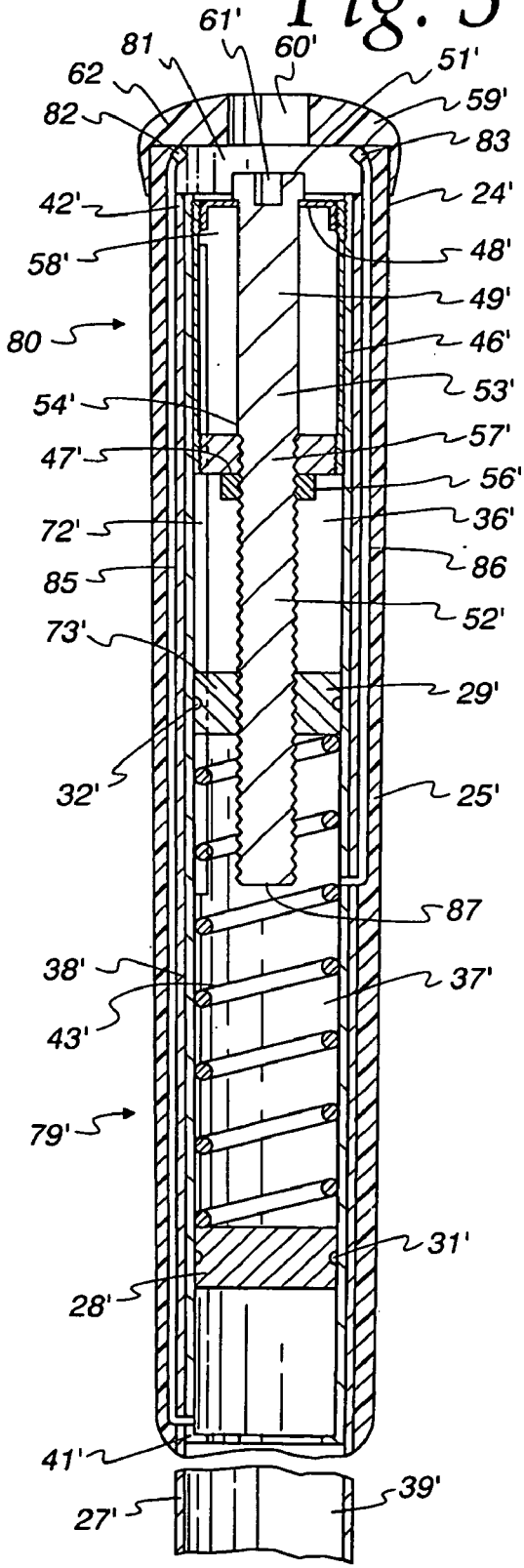
FIG. 5 is a fragmentary vertical axial sectional view similar to FIG. 2A but showing another alternative embodiment of a shaft structure of the present invention, the lower portion of the shaft structure being broken away.

Referring to FIG. 5, another golf club embodiment 80 is fragmentarily shown which incorporates a shaft structure 79 of the invention. Components of club 80 which are similar to those of club 20 and of club 70 are similarly numbered but with the addition of prime marks thereto for convenient identification purposes. The club 80 incorporates the key ridge 72' as in the club 70 and the movable platen 29' has a groove 73' that engages and slidably moves over the ridge 72, thereby guiding the movable platen 29' and preventing rotation thereof. The operations of the piston 28' and movable platen 29' are similar to their operations in clubs 20 and 70.

The club 80 is provided with means for separately introducing, if desired, a fluid into chamber 39'. Thus, in the club 80, a chamber 81 is provided between the upper end 59' of the handle 25' and the cap 48'. The upper end 59' is provided with a cover 62 for handle 25. In addition to accommodating the head 51' of the jackscrew 49', the chamber 81 accommodates a conventional valve 82 (valve 82 is preferably being provided with a friction-fitting cap, not detailed for simplicity). A present preference is for the valve 82 to be similar in construction to the needle-type valve used with conventional footballs and the like where a needle-like member associated with a pressurized conduit is inserted into the valve thereby permitting fluid under pressure to pass through the needle like member and through valve 82 and into the interior of the shaft structure 79. Valve 82 is associated with a conduit 85 that extends generally longitudinally through and downwardly within and radially beneath the handle 25' from the proximal end 24' of the shaft 27' towards the distal end region (not shown) of the shaft 27' along the outside of the shaft 27' to a terminal location that is radially opposite a lower end portion 41' of the sleeve 38'. Here, the conduit 85 extends through the respective walls of the shaft 27' and the sleeve 38' and opens into the chamber 39' that is located forwardly of the piston 28'. In the embodiment 80, the conduit 85 is located on the outside surface portions of the shaft 27 preferably, but alternative arrangements can be used, if desired.

To charge the chamber 39' with a fluid, the cap on the valve 82 is removed and the valve 82 is associated with a conventional needle type valve connector (not shown) that is itself associated with a delivery hose (not detailed) and a desired fluid is input into the chamber 39' through the valve 82. Pressure measuring gauge means (conventional) associated with each such delivery hose can indicate accurately the pressure of the fluid so charged into chamber 39', as those skilled in the art will appreciate.

Figure 6:
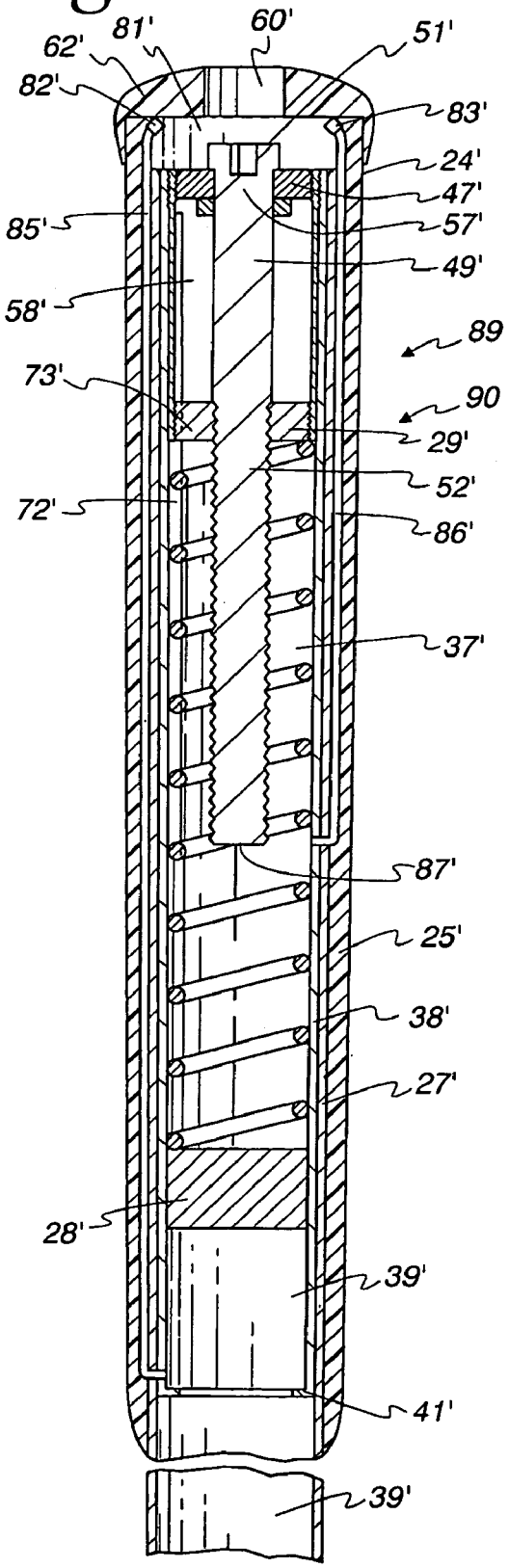
FIG. 6 is a view similar to FIG. 5 but showing a further alternative embodiment of a shaft structure of the invention.

Referring to FIG. 6, a further golf club embodiment 90 is fragmentarily shown which incorporates a shaft structure 89 of the invention. Components of club 90 which are similar to those of clubs 20, 70 and 80 are similarly numbered but with the addition of prime marks thereto for identification purposes. The club 90 incorporates the key ridge 72' and the bulkhead 47' as in the club 70 and the movable platen 29' has a groove 73' that engages and slidably moves over the ridge 72'; thereby guiding the movable platen 29' and preventing rotation thereof. The operations of piston 28' and movable platen 29' in embodiment 90 are similar to their operations in clubs 20 and 70.

Similarly to the club 80, the club 90 is provided with means for separately introducing a fluid into chamber 39'. The periphery of bulkhead 47' threadably engages the upper end portion of the sleeve 38' and the sleeve 38' upper end portion threadably engages the proximal end portion 24' of the shaft 27'. As in the club 80, a chamber 81' is provided between the upper face of the bulkhead 47' and the cap 62'. In addition to accommodating the head 51' of the jackscrew 49', the chamber 81 accommodates conventional valves 82' that is preferably capped (not detailed). Valve 82' is associated with a conduit 85' that extends from the proximal end 24' of the shaft 27' towards the distal end region (not shown) of the shaft 27' along the outside of the shaft 27' and beneath the handle 25' to a location radially opposite a lower end portion 41 of the sleeve 38' where the conduit 85' extends through the respective walls of the shaft 27' and the sleeve 38' and opens into the chamber 39'. In the embodiment 90, the conduit 85' is located on the outside surface portions of the shaft 27 preferably, but alternative arrangements can be used, if desired.

To charge the chamber 39' with a fluid, the cap on the valve 82' is removed and the valve 82' is associated with a conventional valve connector associated with a hose (not detailed but conventional) and a desired fluid is input into the chamber 39'. Pressure measuring gauge means (conventional) associated with each such delivery hose can indicate accurately the pressure of the fluid so charged into chamber 39', as those skilled in the art will appreciate.

Figure 7:
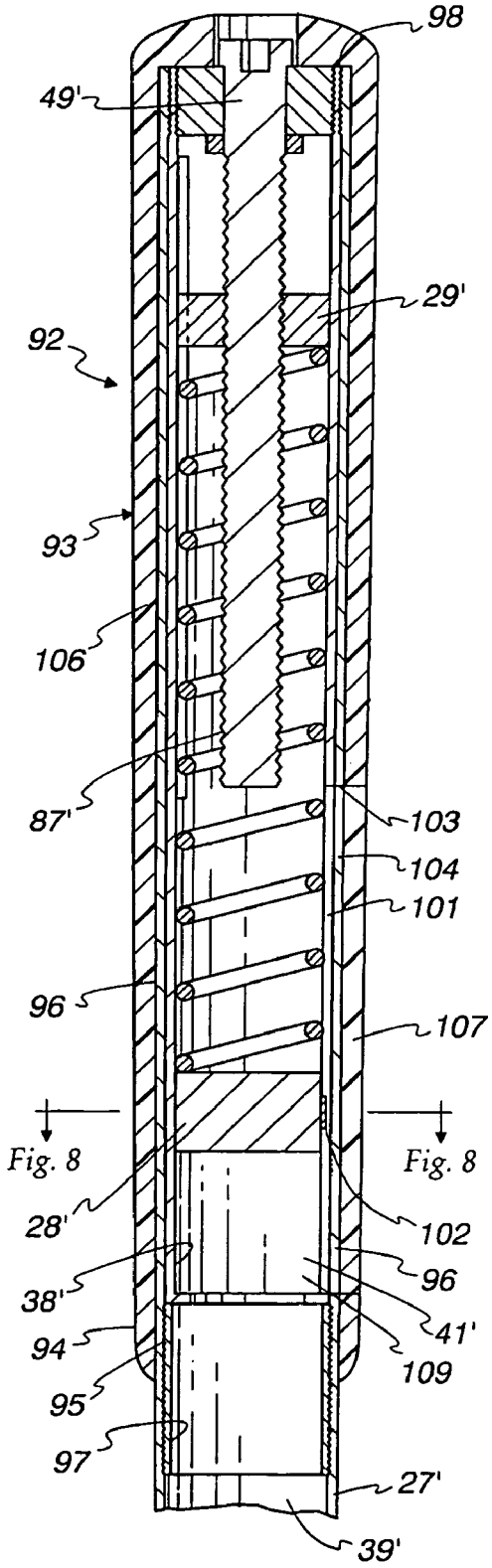
FIG. 7 is a fragmentary vertical axial sectional view similar to FIG. 6 but showing a further alternative embodiment of the present invention wherein a handle structure incorporates components of the invention, the handle structure being illustratively disassociatably associated with the upper end region of the shaft portion of a golf club, the head of the club being removed for simplicity, some parts of the golf club being broken away, the handle structure incorporating with a visual indication means that shows the stiffness of the associated shaft portion.
Figure 9:
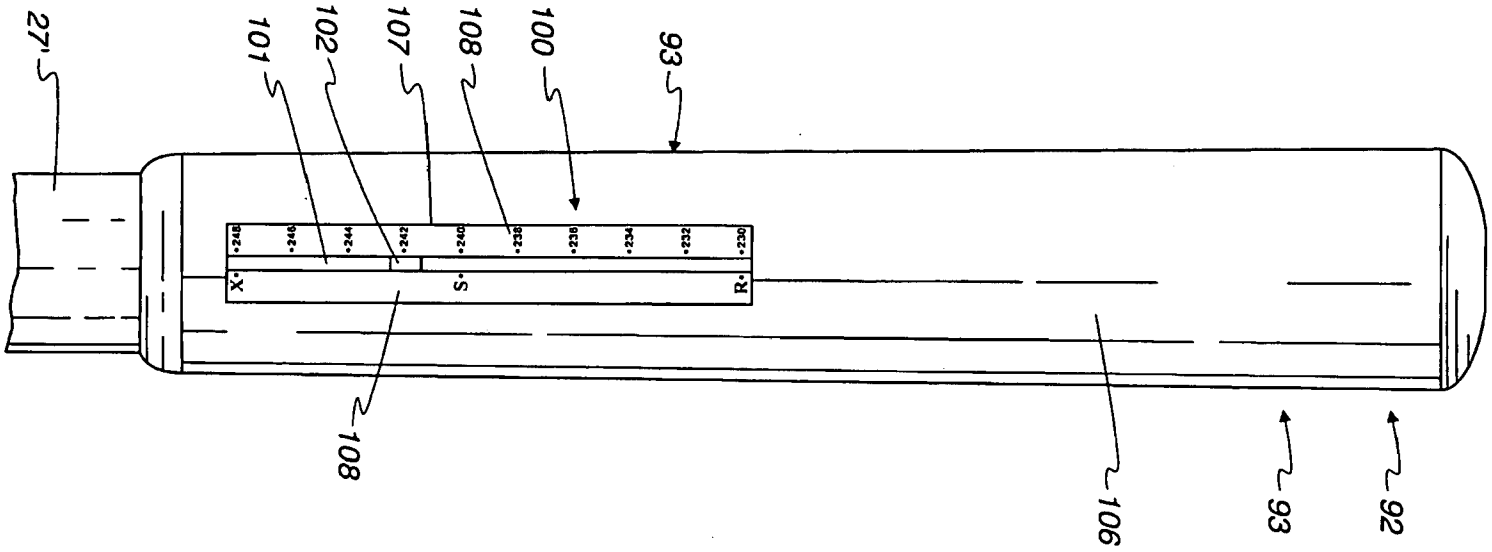
FIG. 9 is a side elevational view of the handle structure of FIG. 7, the handle structure being axially rotated about 90° relative to its orientation in FIG. 7.
Figure 8:
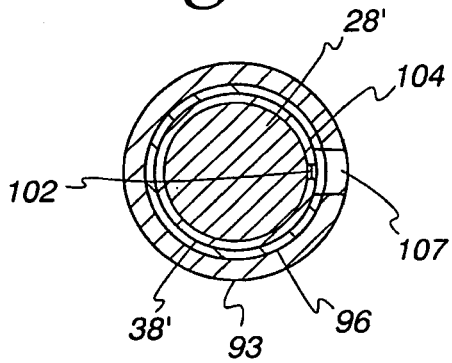
FIG. 8 is a transverse sectional view taken along the line VIII—VIII of FIG. 7.

A further embodiment of the invention is illustrated by the golf club structure 92 shown in FIGS. 7–9. Certain components of club structure 92 (see, for example, FIG. 7) are similar to, or correspond with, components of the club structure 90 (FIG. 6) and are similarly numbered for convenience. The handle structure 93 of club structure 92 thus incorporates components which are useful in the practice of the invention and which function as above explained. The handle structure 93 is suitable for manufacture and usage as an independent item of commerce for manufacture and sale with golf shafts, such as a golf club shaft 96, and the like, thereby to provide golf clubs for use by golfers. When the handle structure 93 is connected to a golf club shaft 27', one is enabled to control and regulate the stiffness of the associated golf club 90 as taught herein by the present invention.

In golf club structure 92, the handle structure 93 comprises an independent and separately fabricated subassembly whose lower end region 94 is connected to the upper end region 95 of a hollow golf shaft 27'. While various shaft 27'/handle 93 interconnection means can be employed, as will readily be appreciated by those skilled in the art, it is presently preferred to have the handle 93 be reversibly interconnected with a shaft 27', thereby permitting the handle 93 to be successively connectable to various shafts 27', if desired, and also permitting the handle 93 to be separated from a shaft 27' for purposes of maintenance, replacement, or the like, as might be desired.

Figure 14:
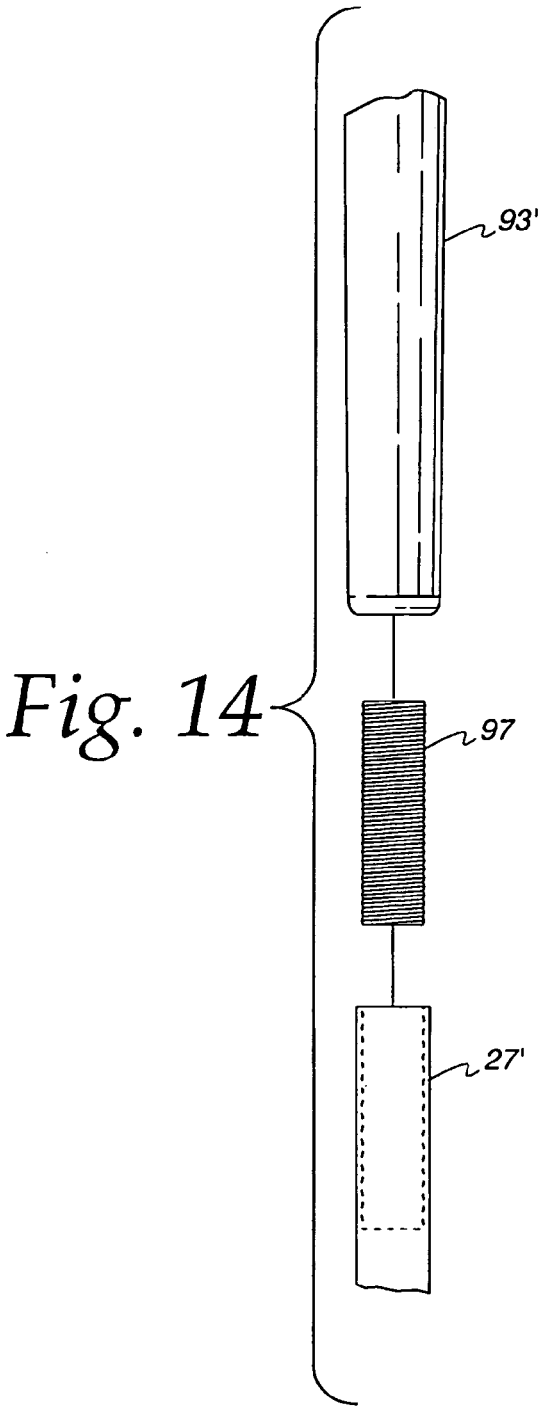
FIG. 14 is a fragmentary, diagrammatic, exploded view in side elevation of a golf club structure with a shaft having an upper end portion associatable with the lower end portion of a detachable handle, such a structure being further illustrative of that utilizable with the illustrative golf shaft structures shown in FIGS. 7–9, 10, 11, 12, and 13.

A handle structure 93 conveniently and preferably incorporates a tubular shaft 96 which can be similar to shaft 27' in diameter and thickness. In the handle structure 93, the shaft 96 can be considered to replace the shaft 27'. As illustrated in FIGS. 7 and 14, for example, one presently preferred interconnection means is illustratively achieved by a nipple 97 with exterior threads extending inwards from each opposite end thereof and which threads are adapted to threadably engage adjacent respective threaded interior regions of the lower end region 94 of shaft 96 and of the upper end region 95 of shaft 27'. In handle subassembly 93, one end of the nipple 97 is adapted to engage threadably and abuttingly the in-turned adjacent end of the sleeve 38' which can aid in centering the nipple 97 between the shaft 96 of the handle 93 and the upper end region of the shaft 27' and in maximizing the strength of the connection between nipple 97, shaft 96, and shaft 27', as those skilled in the art will appreciate. As the handle 93 is connected to the shaft 27', the chamber 39' is connected to the chamber 109 in the handle 93 that is located forwardly of the piston 28'.

The handle 93 incorporates a visual readable stiffness indicating system 100 that shows in real time the stiffness of the associated shaft 27' and shaft 96 based on fluid pressure in chambers 109 and 39'. Thus, the telescopically received sleeve 38' in shaft 96 has a longitudinally extending slot 101 defined therein commencing in spaced adjacent relationship to the lower edge portion 41' thereof and extending upwards to a location approximately opposite the lower end portion 87' of jackscrew 49'. A peripheral side edge portion of the piston 28' is provided with a projection 102. The projection 102 is adapted to slidably extend in and along the slot 101 as the piston 28' is slidably moved responsive to slidable movements of the movable platen 29' achieved as above explained. Thus, the position of the projection 102 at any given time is an accurate indication of the pressure or stiffness of the shaft 96 and shaft 27' (analogously to shaft 27 or 27' as above described).

The shaft 96 is provided with a slot 103 that is located in radially adjacent relationship to the slot 101. The slot 103 is provided with a sealingly engaged transparent window 104, preferably defined by a shock resistant acrylic plastic or the like, through which the position of the projection 102 is visible yet which permits a fluidic pressure provided in the adjacent chamber 109 to be maintained, as desired. The perimeter of the slot 103 and the window 104 can be provided with a mating, longitudinally extending combination of grooves and ridges (not detailed) to provide, preferably with a sealing or adhexive agent, a seating and sealed engagement between slot 103 and window 104, or the like, as may be desired.

The handle 93 exterior surface portions are preferably provided by a readily gripable molded plastic cover 106 which may have an exterior design (not illustrated) suggesting a wrap of strip material or the like, if desired (to resemble the exterior of a conventional golf club handle) and which can be premolded and then slidably extended over the handle shaft 96 beginning at the upper end region 98 thereof. As formed, the cover 106 includes a transparent window 107 that extends longitudinally in and therealong. Conveniently and preferably, the window 107 is molded with the cover 106 and is sized and positioned so as to overlie the window 104 in the assembled handle 93.

Indicia 108 are preferably provided that are located preferably along edge portions of the window 107. As illustrated in FIG. 9, one set of the indicia can include, for example, a well-known stiffness designation that is often referred to as Regular (R), Stiff (S) and Extra Stiff (X), and another set of the indicia can be calibrated in numbers such as are used by those skilled in the art to indicate shaft flexural cycles expressed in cycles per minute. Flexural cycles of a golf shaft or the like can be preliminarily determined at a golf club manufacturing facility or the like. The indicia 108 are preferably oriented in a club 92 so that a golfer can read same while the club is generally in an upright or use orientation, such as illustrated in FIG. 9. Other indicia of course can be used as desired without departing from the spirit and scope of the invention.

Figure 10:
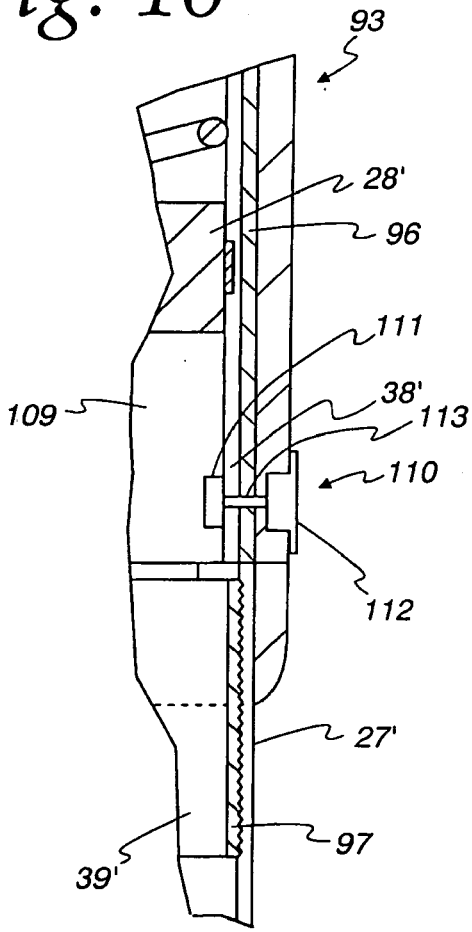
FIG. 10 is a fragmentary view of a handle structure similar to that shown in FIG. 7 but wherein the handle structure incorporates an alternative embodiment of shaft stiffness visual indication means.

An alternative shaft stiffness indicating system 110 is illustrated in FIG. 10. Here the stiffness indicating system 100 is replaced by a combination of pressure sensing transducer 111 and metering device 112 which are both commercially available components. The pressure transducer 111, as positioned in, for example, chamber 109, senses pressure in chambers 109 and 39' (and hence measures, with calibration, shaft stiffness). The signal output from transducer 111 is fed through the sidewalls of shaft 96 and sleeve 38' via an interconnecting small cable 113 to the metering device 112. The device 112 can either use an analog output to cause a needle to rotates responsively to input signals over a calibrated background face dial of a display surface, or use a digital output to cause a calibrated numerical readout to appear on a display device using a liquid crystal or the like. Thus a golfer, for example, views with system 110 a visually readable signal output showing estimated stiffness of the shaft 27' of his selected golf club. Remaining components of handle structure 93 used with system 110 can be as indicated for the club structure 92, or otherwise as desired.

Figure 11:
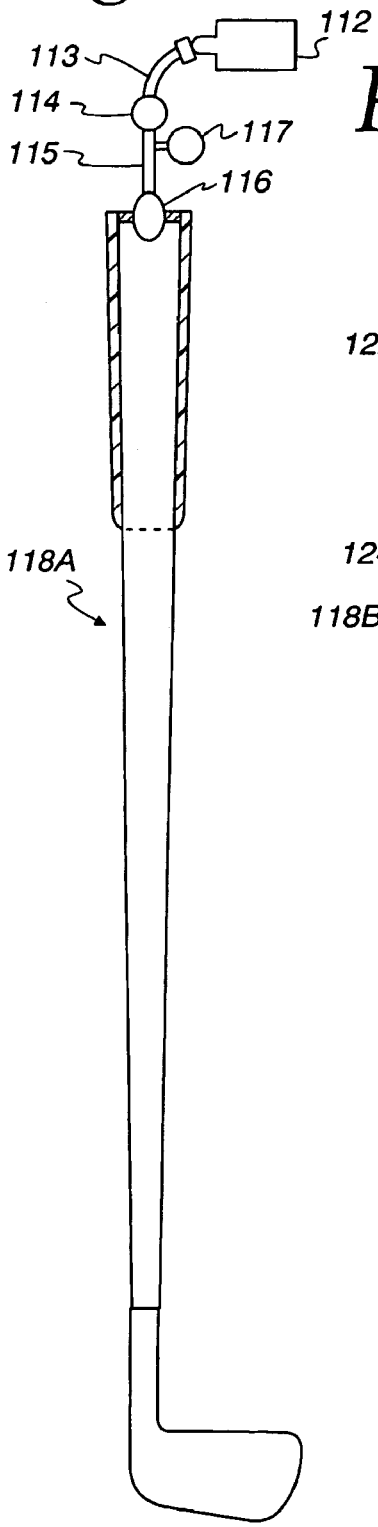
FIG. 11 is a diagrammatic side elevational view of an embodiment of an illustrative inventive golf club wherein shaft stiffness is controlled by manually regulating the fluid pressure therein.
Figure 12:
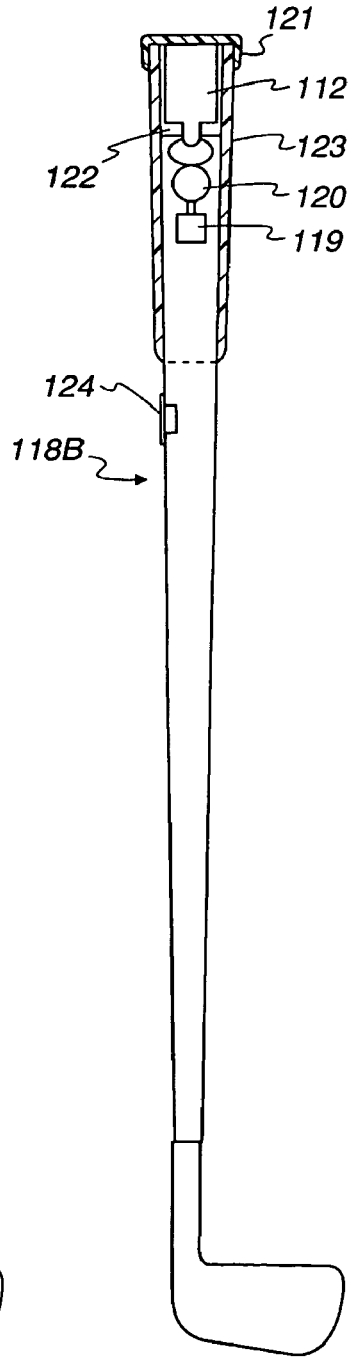
FIG. 12 is a diagrammatic side elevational view of another embodiment of an illustrative inventive golf club where shaft stiffness is controlled by automatically regulating the fluid pressure therein.
Figure 13:
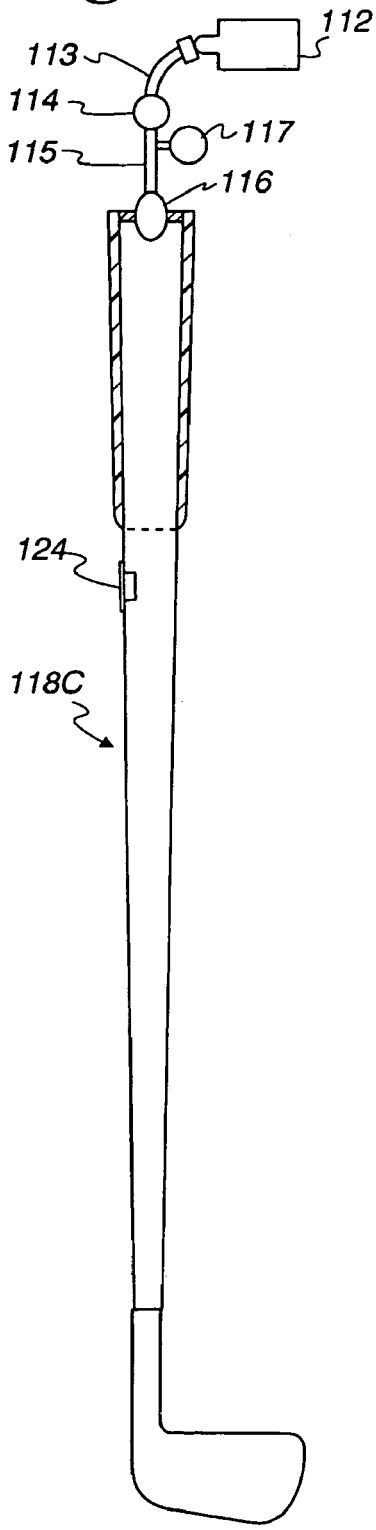
FIG. 13 is a diagrammatic side elevational view of another embodiment of an illustrative inventive golf club wherein shaft stiffness is controlled by a combination of manual pressure charging with automatic regulation of shaft internal fluid pressure.

FIGS. 11–13 illustrate golf shaft embodiments of the invention wherein shaft stiffness is determined and regulated without the use of pistons. In the embodiment of FIG. 11, shaft stiffness is regulated by shaft internal fluid pressure that is manually adjusted by a golfer or the like. In the embodiment of FIG. 12, shaft stiffness is regulated by shaft internal fluid pressure that is automatically adjusted. In the embodiment of FIG. 13, shaft stiffness is regulated by shaft internal fluid pressure that is adjusted both manually by a golfer and automatically.

Thus, in the embodiment of FIG. 11, a conventional canister 112 is employed which is preferably small and that is charged with a compressed gas which is preferably inert. The compression pressure of the gas in the canister 112 is above atmospheric pressure and preferably is initially significantly above atmospheric pressure. The canister 112 is connected to a conduit 113 leading to a manually operated (opened and closed) valve 114. The valve 114 is further connected via a conduit 115 to a so-called conventional needle (not detailed) and the needle is connected (inserted)

into a conventional type needle-fill valve 116 (not detailed). The needle and the valve 116 are each of the conventional type employed with inflatable athletic equipment, such as footballs and the like. Valve 116 is conveniently and preferably joined to and functionally connected with the upper end of a handle-equipped, generally hollow, sealed, internally pressurizable shaft of a golf club 118A. Connected also into the conduit 115 is a conventional gas pressure gauge 117 which is conveniently of the analog, visually readable type. The gauge 117 can be calibrated to read either in pounds per square inch (gauge) or in shaft stiffness (if the latter, then a preliminary calibration is carried out to correlate pounds per square inch with desired shaft stiffness units). Thus, when the needle valve 116 is functionally associated with the conduit 115, and the canister 112 is functionally associated with the valve 114, and the valve 114 is opened, gas passes from the canister 112 into the shaft of the handle-equipped golf club 118A. The pressure in the club 118A shaft is allowed to rise to a desired value as shown by gauge 117 corresponding to a desired shaft stiffness whereupon the valve 114 is closed by the user (typically, a golfer). After shaft pressurization, the canister 112 and the conduit 113 can be disconnected from the club 118A.

When the environmental temperature declines to a lower value relative to its initial level, and after the club 118A becomes equilibrated relative to that lower environmental temperature, then the internal pressure in the shaft decreases. To return the internal shaft pressure to its initial set value, the user increases the internal pressure in the shaft. This can be variously accomplished manually, but in the apparatus of FIG. 11, is readily accomplished by reconnecting the canister 112 and the conduit 113 with the valve 114 and allowing gas to pass from the canister 112 through the valve 114 and into the shaft of the club 118A until the pressure in the shaft, as shown by the gauge 117, is returned to its initial set value whereupon the user closes the valve 114 and separates the canister 112 and the conduit from the valve 114.

When the environmental temperature rises to a higher value relative to its initial level, and after the club 118A becomes equilibrated relative to that higher environmental temperature, then the internal pressure in the shaft increases. To return the internal shaft pressure to its initial set value, the user reduces the internal pressure in the shaft. This can be variously accomplished manually, but in the apparatus of FIG. 11, is readily accomplished by the user opening the valve 114 to the atmosphere and allowing gas from the shaft of the club 118A to escape until the gauge 117 shows that the pressure in the shaft of the club 118A has been reduced to its initial set value whereupon the valve 114 is closed.

In the embodiment of FIG. 12, the handle 123 of the golf club 118B is modified. The upper end portion or mouth of the handle 123 is provided with a cap 121, preferably one that has a down-turned lip peripherally that is provided with internal screw threads that threadably engage outside screw threads located about the mouth of the handle 123. A cavity 122 is defined internally in the handle 123 adjacent to the handle 123 mouth, the cavity 122 being adapted to receive therein head first a small canister of pressurized gas, such as, illustratively, the canister 112. The neck region of canister 112 that is adjacent the valved port thereof (not detailed) is adapted to seat against the input orfice of a conventional valve 120 (not detailed) that is mounted in the handle interior. Conventional O-ring members (not detailed) achieve a sealed engagement between the canister 112 neck region and the valve 120 when the cap 121 is abutted against the bottom portion of the canister 112 and the cap 121 closed and screwed down over the mouth of the handle 123 whereby the canister 112 is compressed axially (relative to the handle 123) against the valve 120 input orfice. The valve of the canister 112 is thereby opened, but the valve 120 remains initially in a valve closed configuration.

Figure 15:
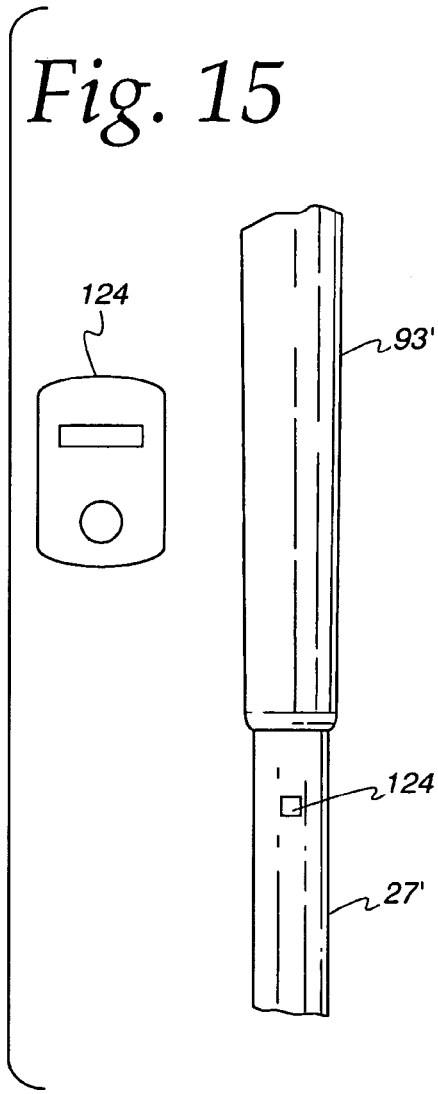
FIG. 15 is a fragmentary view in side elevation illustrating the combination of club structure and actuating separate and remotely situatable control device for valve actuation, such a combination being utilizable in, for example, the golf clubs shown in FIGS. 12 and 13.

The valve 120 is provided with conventional electromechanical arrangement 119 that is adapted to open and close the valve 120 in response to radio pulse signals generated exteriorly and nearby (but relatively remotely) by a small button-equipped actuator box 124 equipped with a conventional radio pulse generating arrangement, such as diagrammatically shown in FIG. 15, for example. Preferably, the box 124 contains solid state microcircuitry of the conventional type used in contemporary automobile keys, garage door openers, and the like, for example. When a button on the box 124 is finger actuated by a user, a low strength radio pulse is generated and transmitted to a receptor associated with microcircuitry functionally connected to the valve 120 associated electromechanical means. The pulse actuates and opens the valve 120 causing gas to be discharged from the canister into the shaft of the club 118B.

The valve 120 electromechanical arrangement 119 is further provided with a conventional pressure-sensing transducer and associated microcircuitry which is preliminarily adjusted to shut automatically the valve 120 when a predetermined pressure is achieved in the shaft, the pressure chosen being sufficient to achieve a desired stiffness for the shaft, and the valve 120 once actuated by the box 124 switch button being automatically opened whenever the shaft internal pressure drops below the predetermined pressure. If desired, the valve 120 can be shut off by the same switch button arrangement on box 124.

When the environmental temperature declines to a lower value relative to its initial level, and after the club 118B becomes equilibrated relative to that lower environmental temperature, then the internal pressure in the shaft decreases. However, when the shaft internal pressure decreases, the valve 120 opens and returns the internal shaft pressure to its initial set value in club 118B before the switched on valve 120 again shuts off automatically responsive to pressure.

When the environmental temperature rises to a higher value relative to its initial level, and after the club 118B becomes equilibrated relative to that higher environmental temperature, then the internal pressure in the shaft increases. To return the internal shaft pressure to its initial set value, the internal pressure in the shaft is automatically reduced by a valve 124 mounted through the shaft at a location therealong in the club 118B. Valve 124 like valve 120 is associated with a conventional combination of pressure sensing transducer and microcircuitry (not detailed) that is adapted to open the valve 124 to the atmosphere when the pressure in the shaft of the club 118B exceeds the initial set value and to close the valve 124 when the pressure in the shaft is at or below the initial set value. Thus, once the initial pressure for the shaft interior is set relative to valves 120 and 124, the pressure in the shaft of the club 118B (and thus the stiffness of that shaft) is automatically maintained.

In the embodiment of FIG. 13, a canister 112 illustratively again employed which is conveniently connected with the upper end of the golf club 118C in a manner similar to that utilized with the golf club 118A of FIG. 11 and the shaft of the golf club 118C is similarly pressurized to a desired level.

When the environmental temperature declines to a lower value relative to its initial set level, and after the club 118C becomes equilibrated relative to that lower environmental temperature, then the internal pressure in the shaft decreases. To return the internal shaft pressure to its initial set value, the user increases the internal pressure in the shaft. This can be variously accomplished manually, but, in the apparatus of FIG. 13, is readily accomplished by reconnecting the canister 112 and the conduit 113 with the valve 114, as in the apparatus of FIG. 11, and the pressure in the shaft of the club 118C is allowed to rise until the pressure in the shaft, as shown by the gauge 117, is returned to its initial set value.

When the environmental temperature rises to a higher value relative to its initial level, and after the club 118C becomes equilibrated relative to that higher environmental temperature, then the internal pressure in the shaft increases. To return the internal shaft pressure to its initial set value, the internal pressure in the shaft is automatically reduced in the manner practiced with club 118B by a valve 124 mounted along the shaft of the club 118C. Valve 124 opens to the atmosphere when the pressure in the shaft of the club 118C exceeds the initial set value and closes when the pressure in the shaft is at or below the initial set value.

EXAMPLE

In golf club 20, as the environmental temperature T increases, the shaft 21 internal pressure P increases in accordance with the so called ideal gas equation (1):

$$PV=nRT \quad (1)$$

where: P=gas pressure
V=volume of gas
n=number of moles of gas
R=a constant
T=temperature In the prior art, the volume of the shaft interior is constant so that pressure must necessarily increase giving rise to an increase in shaft stiffness. In club 20, as T increases, the pressure P increases proportionately according to equation (1). In order for the pressure P in chamber 36 to remain constant, the volume V must necessarily decrease a proportionate amount when in a static mode (that is, a use situation where the golfer is not adjusting the stiffness of the shaft 71 by changing the position of the movable platen 29). As the environmental temperature increases, the pressure in chamber 36 increases and produces a force F upon the piston 28 as summarized by equation (2):

$$F=PA \quad (2)$$

where: F=force exerted against piston 28
P=gas pressure
A=area of piston 28

The force exerted tends to move the piston 28 upwards (referring to FIGS. 2A and 2B) thereby compressing the spring 43. The compressing of the spring 43 continues until the point where the force of the spring 43 balances the force of the fluid (illustratively, air) in chamber 36.

The force exerted by the spring 43 is a function of how much the spring 43 is compressed according to equation (3):

$$F=kx \quad (3)$$

where: F=force exerted by spring 43
x=distance spring is compressed
k=spring constant Substituting the force of the gas in chamber 36 from equation (2) and solving for x yields equation (friction of a seal may be ignored) (4):

$$x=(P*A)/k \quad (4)$$

Therefore, the piston 28 will move x amount of measured units (meters) up (as temperature increases) or down (as temperature decreases) until an equilibrium is reached.

When a golfer chooses to stiffen the shaft 21, he/she simply turns the jackscrew 49 causing the movable platen 29 to move by a proportionate amount downwards. Moving the movable platen 29 downwards effectively causes spring 43 to compress. Spring 43 compressing introduces a change in force as predicted by equation 3 upon piston 28 causing piston 28 to move downwards. The downward movement of piston 28 reduces the volume and increases pressure in chamber 36. The resulting pressure can be approximated by the above equations.

When a golfer chooses to make shaft 21 less stiff, he/she simply turns the jackscrew 49 causing the movable platen 29 to move by a proportionate amount upwards. Moving the movable platen 29 upwards effectively causes spring 43 to uncompress. Spring 43 uncompressing reduces the force imposed upon piston 28 causing piston 28 to move upwards. The upward movement of piston 28 increases the volume and decreases pressure in chamber 36. The resulting pressure can be approximated by the above equations.

Various modifications, changes and variations in the invention may be apparent to those skilled in the art. Such alterations can be carried out without departing from the spirit and scope of the present invention which is intended only to be limited by the scope and content of the appended claims.

What is claimed is:

1. A shaft structure having an adjustable stiffness comprising in combination:

a flexible, elongated shaft having defined therein an elongated enclosed cavity; and means for regulating pressure in said cavity by changing the volume of said cavity, whereby the stiffness of said shaft is regulatable by said pressure in said cavity, including longitudinally slidably movable piston means and platen means in said shaft, spring biasing means located between said piston and said platen means, and jackscrew means mounted in said shaft and coupled to said platen means so as to threadingly displace said platen means;

whereby said piston means assumes a longitudinal location in said shaft such that forces on longitudinally opposed sides thereof are about equal and when said platen means is moved longitudinally by said jackscrew, the force on the longitudinally adjacent side of said piston means is changed and said piston means longitudinally moves responsively to a different location where the forces on longitudinally opposed sides of said piston means are again about equal.

2. A shaft structure having a variable but regulatable stiffness comprising:

a hollow shaft having closed opposite end regions;

longitudinally slidably movable piston and platen in said shaft;

spring biasing means located between said piston and platen; and jackscrew means longitudinally extending in said shaft from one said end region thereof and being rotatable relative thereto and threadably engaged with said platen;

whereby said piston assumes a longitudinal location in said shaft where force on each side thereof is about equal and, when said platen is moved longitudinally by said jackscrew so that force on one side of said piston is changed, said piston longitudinally moves responsively to a different location where opposite side forces thereon are again about equal.

3. A shaft structure for a club having a stiffness which is automatically regulated when the environmental temperature changes, said shaft structure comprising in combination:

a fluid impermeable, hollow, fluid holding, elongated shaft having opposed proximal and distal end regions;

a piston and platen longitudinally slidably located in said shaft in longitudinally spaced relationship relative to each other so that a second chamber is defined there between in said shaft, said piston being in fluid tight relationship relative to said shaft, said piston being in longitudinally spaced relationship relative to said distal end so that a first chamber is defined there between in said shaft;

spring biasing means between said piston and platen;

keyway means for guiding longitudinal movement of said platen and for preventing rotational movement of said platen, relative to said shaft;

jack screw means extending longitudinally in said shaft between said platen and said proximal end region, said jack screw means having a forward end-adjacent region that is threadably engaged with said platen and having a rearward end-adjacent region that is slidably and rotatably movable relative to said proximal end region, whereby, when rotational force is applied to said rearward end-adjacent region, said jackscrew rotates but remains longitudinally stationary thereby causing said platen to move longitudinally and slidably in said shaft, the direction of said platen longitudinal movement being dependent upon the direction of rotation achieved by said so applied rotational force;

the interrelationship between said shaft, said piston, said platen, said spring biasing means, and said jack screw being such that said piston assumes a longitudinal location in said shaft where the spring biasing force in said second chamber is approximately equal to the fluid pressure in said first chamber, whereby external environmental temperature changes that cause fluid pressure changes in said first chamber are equalized by responsive slidable movement of said piston in said shaft; and when said jackscrew is rotated and said platen is moved longitudinally in said shaft, the force exerted upon said piston by said spring biasing means is changed, thereby causing said piston to assume a different longitudinal location in said shaft where the spring biasing force in said second chamber is again approximately equal to the fluid pressure in said first chamber whereby the stiffness of said shaft structure is adjusted.

4. The shaft structure of claim 3 wherein each of said first chamber contains a gas.

5. The shaft structure of claim 4 wherein said gas is at a higher pressure than ambient atmospheric air pressure.

6. The shaft structure of claim 3 wherein said fluid in said first chamber is a liquid at ambient atmospheric air pressure and temperature.

7. The shaft structure of claim 3 which additionally includes a stationary bulkhead in said shaft that is interposed between said proximal end region and said platen, and said jackscrew slidably and rotatably extends through said bulkhead.

8. The shaft structure of claim 7 wherein a plurality of guide pins longitudinally extend from said platen and through said bulkhead so that, during longitudinal movements of said platen responsive to rotation of said jackscrew, said platen is maintained in a fixed transverse orientation relative to said shaft, whereby said guide pins provide said keyway means for guiding longitudinal movement of said platen, and for preventing rotational movement of said platen, relative to said shaft.

9. The shaft structure of claim 3 wherein said shaft is provided with stop means limiting slidable movement of said piston towards said distal end region, thereby limiting the maximum fluid pressure which can be produced in said first chamber through movement of said piston.

10. The shaft structure of claim 9 wherein interior surface portions of said shaft in the region between said proximal end region and said stop means are provided with sleeve means over which peripheral portions of said piston and platen are slidable.

11. A shaft with automatically regulated stiffness comprising in combination:

(a) a fluid impermeable, cylindrical shaft having a shaft first end region and a shaft opposite end region;

(b) a longitudinally slidable, fluid impermeable piston disposed in said shaft;

(c) a fluid-holding first chamber in said shaft located between said piston and said shaft first end region;

(d) a longitudinally slidable, platen disposed in said shaft;

(e) a second chamber in said shaft located between said piston and said platen;

(f) spring biasing means in said second chamber that extends between said piston and said platen; and (g) a jack screw that extends axially in said shaft from said shaft opposite end region through said platen that includes first and second longitudinally adjacent circumferential portions, said first portion being longitudinally fixed relative to said shaft but rotatable in unthreaded relationship relative to said shaft, and said second portion being threadably engaged with said platen whereby rotational force applied to said jack screw exteriorly of said shaft causes said platen to longitudinally move along said jack screw in said shaft, the direction of longitudinal movement depending upon the direction of rotation achieved by said applied rotational force;

the interrelationship between said piston, said platen, said spring biasing means, and said jack screw in said shaft being such that said piston assumes a location in said shaft where the fluid pressure in said first chamber is proportional to the spring biasing force in said second chamber, and when said platen is so moved longitudinally by said jackscrew, said biasing force in said second chamber is changed, thereby causing said piston to assume a different location in said shaft where the fluid pressure in said first chamber is again proportional to said now changed spring biasing force in said second chamber.

12. A stiffness self-compensating shaft with adjustable stiffness comprising in combination:

(a) a fluid impermeable, hollow shaft having a shaft first end region and a shaft opposite end region;

(b) a longitudinally slidable, fluid impermeable piston disposed in said shaft and sealingly engaged with adjacent inside wall portions of said shaft, said piston having longitudinally opposed first side and second opposite side portions;

(c) a fluid holding first chamber in said shaft located between said first side of said piston and said shaft first end region, and a fluid in said first chamber;

(d) a longitudinally slidable, platen disposed in said shaft;

(e) a second chamber in said shaft located between said first side of said platen and said second side of said piston;

(f) spring biasing means in said second chamber that extends between said first side of said platen and said second side of said piston for exerting a spring biasing force between said piston and said platen; and (g) a jack screw that extends axially in said shaft from said shaft opposite end region through said platen, that includes a first circumferential portion which is longitudinally fixed relative to said shaft opposite end region but which is rotatable in unthreaded relationship relative thereto, and that includes a second circumferential portion which is threadably engaged with said platen, whereby rotational force applied to said jack screw exteriorly of said shaft causes said platen to longitudinally move in said shaft in a direction that depends upon the direction of rotation achieved by said applied rotational force;

the interrelationship between said piston, said platen, said spring biasing means, and said jack screw in said shaft being such that (a) said piston is located in said shaft at a longitudinal position therein where the pressure in said first chamber substantially corresponds to the force of said spring biasing means;

(b) changes in exterior environmental temperature causes corresponding pressure changes in said first chamber which causes compensatory movement of said piston in said shaft thereby maintaining an equalized pressure on each side of the said piston existing in respectively said first chamber and said second chamber so that said shaft stiffness is automatically regulated;

(c) when said platen is advanced along said jack screw in a direction away from said shaft opposite end, such advance tends to cause:

said spring biasing means to compress;

said piston to longitudinally move in said shaft towards said shaft first end region and to increase the pressure in said first chamber, the extent of such longitudinal movement being such as to equalize the pressure in each of said first chamber and said second chamber; and correspondingly (d) when said platen is retracted along said jack screw in a direction towards said shaft opposite end, such advance tends to cause:

said spring biasing means to elongate;

said piston to longitudinally move in said shaft away from said shaft first end region and to decrease the pressure in said first chamber, the extent of such longitudinal movement being such as to equalize the pressure in each of said first chamber and said second chamber, whereby rotational movement of said jackscrew causes changes in the stiffness of said shaft.

* * * * *